US007559124B2

(12) United States Patent
Poulakis

(10) Patent No.: US 7,559,124 B2
(45) Date of Patent: Jul. 14, 2009

(54) HOOK AND LOOP CONNECTOR PIECE

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 401 days.

(21) Appl. No.: 10/594,300

(22) PCT Filed: Mar. 3, 2005

(86) PCT No.: PCT/EP2005/002216

§ 371 (c)(1),
(2), (4) Date: Sep. 26, 2006

(87) PCT Pub. No.: WO2005/096863

PCT Pub. Date: Oct. 20, 2005

(65) Prior Publication Data

US 2008/0222856 A1 Sep. 18, 2008

(30) Foreign Application Priority Data

Mar. 30, 2004 (DE) ..... 10 2004 015 321

(51) Int. Cl.
*A44B 18/00* (2006.01)

(52) U.S. Cl. ..... 24/452; 24/442; 428/100

(58) Field of Classification Search ..... 24/452, 24/306

See application file for complete search history.

(56) References Cited

U.S. PATENT DOCUMENTS

| | | | | |
|---|---|---|---|---|
| 4,693,921 | A | 9/1987 | Billarant et al. | |
| 4,875,259 | A | 10/1989 | Appeldorn | |
| 5,422,156 | A * | 6/1995 | Billarant | 24/306 |
| 5,500,268 | A * | 3/1996 | Billarant | 24/452 |
| 5,725,928 | A * | 3/1998 | Kenney et al. | 24/452 |
| 5,766,723 | A | 6/1998 | Oborny et al. | |
| 5,972,465 | A * | 10/1999 | Ohno et al. | 428/100 |
| 6,537,643 | B1 * | 3/2003 | Poulakis | 428/100 |
| 6,708,379 | B1 | 3/2004 | Wilson | |

FOREIGN PATENT DOCUMENTS

| | | |
|---|---|---|
| DE | 295 05 349 | 8/1995 |
| DE | 198 28 856 | 10/1999 |
| DE | 100 39 940 | 3/2002 |
| WO | WO 02/13648 A1 * | 2/2002 |

* cited by examiner

*Primary Examiner*—Robert J Sandy
(74) *Attorney, Agent, or Firm*—Roylance, Abrams, Berdo & Goodman, L.L.P.

(57) ABSTRACT

A hook and loop connector piece includes a support band (10) with hooking elements (12) arranged on one side and at least one cover strip (20) on an opposite side. The cover strip forms at least one free lateral edge region (21) extending over the corresponding lateral edge (33) of the support band (10). The free lateral edge region (21) of the cover strip (20) may be folded over itself, along a fold line (29) extending in the longitudinal direction. The terminal edge (31) of the free lateral edge region (21) of the cover strip (20) is turned towards the corresponding lateral edge (33) of the support band (10). On the side of the hook and loop connector piece away from the hooking elements (12), a connector (36) for a molded foam is provided. The connector (36) is embodied as a number of projecting separate rods (38) performing the adhesion of the foam without additional projections.

11 Claims, 2 Drawing Sheets

HOOK AND LOOP CONNECTOR PIECE

FIELD OF THE INVENTION

The present invention relates to a hook and loop connector piece comprising a support strip with hooking elements located on it on one side and with at least one cover strip. The cover strip forms at least one free side edge area extending beyond the respective longitudinal edge of the support strip. The respective free side edge area of the cover strip can be folded over itself in the direction to the support strip along a fold line extending in the longitudinal direction. The end edge of the respective free side edge area of the cover strip faces the respective longitudinal edge of the support strip. On the side of the hook and loop connector piece facing away from the hooking elements, a connecting means for mold or molded foam is provided.

BACKGROUND OF THE INVENTION

Hook and loop connector pieces having a plurality of hooking elements made in one piece in the form of stalks with thickenings and located on the hooking or front side of the support strip are conventional. A production process for producing the support strip of these hook and loop connector pieces is described in DE 198 28 856 C1 (corresponding to U.S. Pat. No. 6,627,133). In this process, preferably a thermoplastic, especially a polyolefin or polyamide, in the plastic or liquid state is supplied to a gap between a pressing tool and a molding tool. The shaping element on the molding tool is a screen with continuous cavities. The hooking elements are formed by the thermoplastic which at least partially hardens in the cavities of the screen. In this way, a micro-hook and loop fastener with 200 to 400 hooking elements per $cm^2$ is formed. Instead of the mushroom-shaped hook and loop elements formed in this connection, a support strip can also be provided in the form of a textile material in which the hooking elements are formed by a loop material which is, for example, integral with the textile support strip. Instead of the loop material, a fleece or mushroom structure can also be used.

These hook and loop connector pieces are used for diverse purposes, for example, in motor vehicle engineering, floor installation technology, clothing of any type, and special applications in mechanical engineering. The hook and loop connector pieces have proven themselves in these areas as a detachable and reliable connecting and closing technology. If these hook and loop connector pieces are used for aircraft or vehicle passenger seats, they are used among other purposes to attach seat coverings to foam body parts, ones formed of a molded foam. Some hook and loop connector pieces are foamed into the cushion foam material when the respective seat is being produced. The hook and loop connector piece with the corresponding hooking elements is fastened to the upholstery material, in particular sewn to it. For the purpose of producing the foam body parts, the hook and loop connector pieces are inserted into seating pipes of a foam mold. By insertion of foam material into the free cross sections of the foam mold, preferably polyurethane (PU) foam, the hook and loop connector pieces are fastened to the foam body parts in the process of foaming-in. The parts employed normally project above the other walls of the foam mold, and thus, later form groove-like recesses in the foam body part which is then engaged in the upholstery material with the other corresponding hook and loop connector piece. In this way, geometric seam and shape patterns may be produced on a particular seat depending on the design.

DE-A-100 39 940 (corresponding to U.S. Pat. No. 6,537,643) discloses a generic hook and loop connector piece with a support strip with hooking elements located on it. A cover strip covers the support strip on the side facing away from the hooking elements, and is wider than the support strip so that free side edge areas of the cover strip extend on both sides beyond the longitudinal edges of the support strip. In the known solution, the two free side edge areas of the cover strip are folded around one another such that the end edges of the free side edge areas are facing the longitudinal edges of the support strip. The cover strip on both sides then forms a sealing lip extending along the area having the hooking elements and adjoining the wall parts of the foam mold which surround the mold trough in which the hooking elements are held during the foaming process. The foam material introduced into the foam mold causes this sealing lip to be pressed against the facing wall parts of the mold. The sealing lip, due to a certain flexibility in the area of the fold line, conforms to the wall areas which form the sealing surfaces, so that improved sealing action of the foam barriers is achieved.

Moreover, in the known solution, the support strip can have at least one flexurally stiff reinforcing element extending preferably in the form of a bending wire along the support strip. In foam molding, better embedding properties for hook and loop connector pieces result. Due to the flexural stiffness of the reinforcing element, the hook and loop connector pieces, once inserted in the respective foam mold, remain in their position.

Furthermore, in the known solution the cover strip is formed from a plastic nonwoven to enable good crosslinking with the polyurethane mold foam for producing cushion parts in motor vehicle seats. Especially under subsequent high stress in daily use of the seat, this adhesion is often not adequate and detachment of the hook and loop connector piece from the foam cannot be precluded.

In order to counteract this inadequate adhesion, U.S. Pat. No. 4,693,921 discloses anchor elements attached on the back of the support strip with the hooking elements, with projecting anchor parts to improve adhesion to the molded foam. In practice, in spite of these anchor elements, improved adhesion of the foam to the hook and loop connector piece does not occur. On the contrary, often during the foaming-in process, the anchor elements prevent the foam material from flowing freely by the anchor elements, with the result that in the area of the anchor elements air holes occur in the foam, that is to say, cavities. These cavities in turn unintentionally promote the separation of the hook and loop connector piece and mold foam.

SUMMARY OF THE INVENTION

An object of the present invention is to provide an improved hook and loop connector piece wherein a reliable foam barrier is ensured by the respective side edge area of the cover strip and optimum adherence of the molded foam to the hook and loop connector piece occurs.

This object is basically achieved by a hook and loop connector piece with connecting means formed from a plurality of individual projecting rods. Free of additional projections, the projecting rods effect adherence of the molded foam. The anchor elements with their projecting anchor parts are replaced by pin-like individual rods with smooth surfaces which for this purpose are made free of projections. It is surprising to one with average skill in the art in the field of hook and loop fastener technology that with less use of material, in this instance formed by the individual rods, better adhesion results than in the known anchor elements or with the known nonwoven material of the cover strip.

The individual rods on the side of the hook and loop connector piece facing away from the hooking elements form only a small resistance to inflow of mold foam. The foam material can then flow unhindered to the individual rods, and can completely encompass them without air holes or other cavities forming. By totally surrounding the individual rods with the molded foam, adhesion over a large surface is implemented. The individual rods can be made microscopically small, and still achieve reliable adhesion compared to anchor elements which often have at least the size of the hooking elements on the opposing site or are made still larger to be able to engage the molded foam material as deeply as possible. In this respect, the solution of the present invention is implemented in a space-saving manner.

Moreover, as a result of the folded-over side edge areas, reliable sealing in the foam mold (pipe) is achieved. The hooking elements necessary later for operation of the hook and loop connector piece are not rendered unusable by the molded foam.

In one preferred embodiment of the hook and loop connector piece of the present invention, each individual rod has a cylindrical middle part which undergoes transition on the head side into a convexly made head part, and ends on the foot side via a concavely made foot part in a strip-shaped support part and is connected integrally to it. By changing from convex shaping to concave with incorporation of a cylindrical middle part, an ideal adhesion geometry is achieved. This improved adhesion has been shown by practical tests. The strip-like support part can also be formed to bring about a back-to-back solution by the support strip of the hook and loop connector piece itself. The cover strip with its side edge areas then has to act along the longitudinal edges of the support strip.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 2:
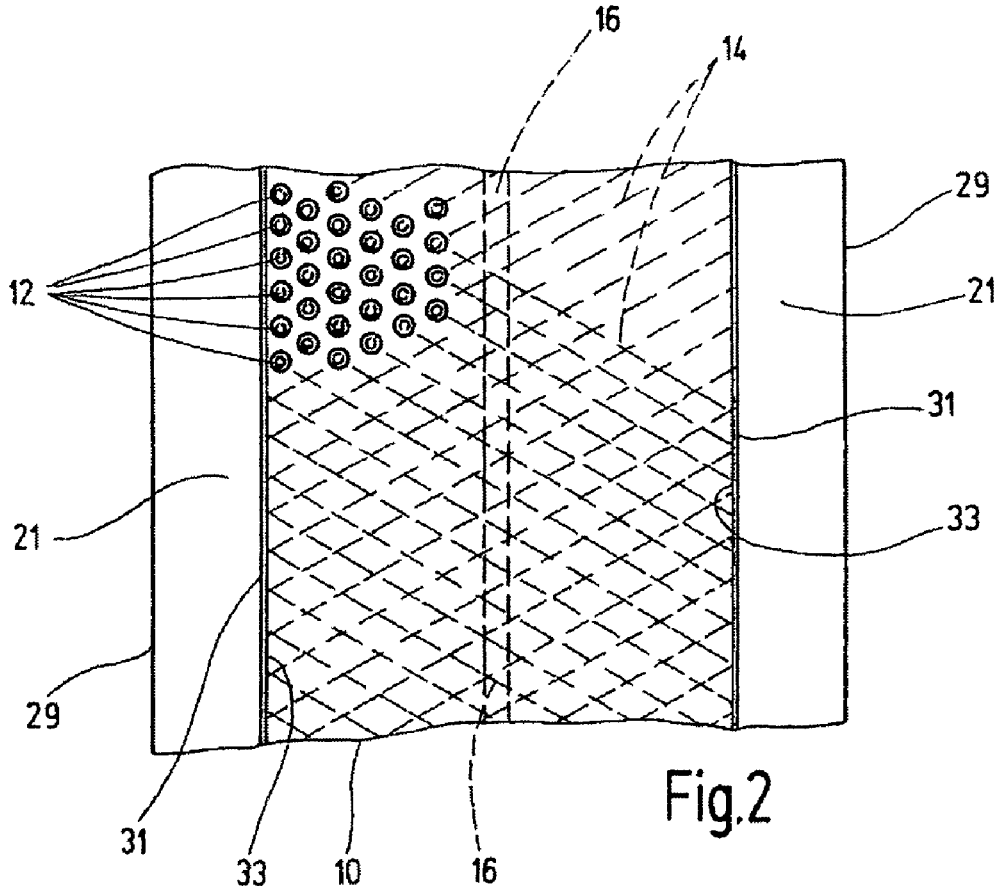
FIG. 2 is a plan view of the hook and loop connector piece of FIG. 1, viewed in the direction of its side having hooking elements.

The hook and loop connector piece according to an exemplary embodiment of the present invention has a support strip 10. On one side of the support strip 10, hooking elements 12 are located in a row next to one another and in succession. The hooking elements 12 shown in FIG. 2 viewed toward the longitudinal direction of the support strip 10 are located in obliquely extending longitudinal and transverse rows. For example, the hook and loop connector piece can be a microfastener in which 200 to 400 hooking elements and more per cm are provided on a support strip 10 with a thickness from 0.1 to 0.3 mm. A process for producing the support strip of such a microfastener is disclosed in DE 198 28 856 C1. In this known process, by preference, a thermoplastic is supplied to the gap between the pressing tool and the molding tool, in which the shaping element is a screen having continuous cavities in which the hooking elements are formed by the plastic which at least partially hardens in the cavities of the screen.

The support strip 10 has a bending-resistant stiffening profile extending along the entire length of the support strip 10. In the illustrated embodiment, this stiffening profile includes a wire 16, especially in the form of a metal wire. The wire 16 is permanently connected via an adhesive layer 18 to the support strip 10 on its back facing away from the hooking elements 12. The adhesive can be, for example, a moisture-crosslinking PU. The adhesive layer 18 completely covers one side of the support strip 10 and is permanently connected to it. The diameter ratios are selected such that the thickness of the adhesive layer 18 corresponds to the thickness of the wire 16. The adhesive layer 18, in terms of its thickness, can only partially accommodate the wire 16 with its given diameter.

The adhesive layer 18 on its side facing away from the support strip 10 has a cover strip 20, preferably in the form of a textile or plastic nonwoven. The cover strip 20 projects laterally along the longitudinal edges 33 of the support strip 10 by a definable distance. On both sides of the support strip 10, one respective free side edge area 21 each is formed with the cover strip 20. Each free side edge area 21 is designed to rest against the wall part 22 on the top of the seating pipe 24 which is a component of the foam mold (not shown) in FIG. 1. The seating pipe 24 has a mold trough in the form of a recess 28. The recess free cross section is matched to the support strip 10 of the hook and loop connector piece to be accommodated in this mold trough with its hooking elements 12 in the form of hooking mushrooms. The hooking elements 12 generally make contact with the base of the recess 28 on the front or button side.

Figure 1:
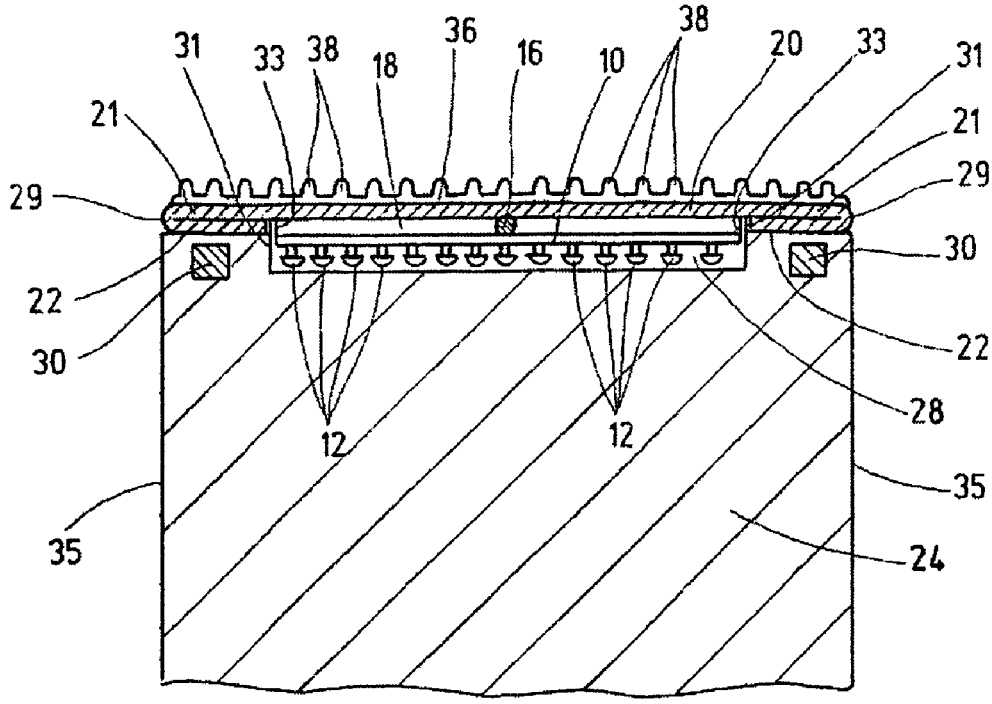
FIG. 1 is a front elevational view in section of a seating pipe for a foam mold with a hook and loop connector piece inserted into the mold trough of the seating pipe (shown partially) according to an exemplary embodiment of the present invention.

The free side edge areas 21 of the cover strip 20, as is apparent from FIG. 1, are folded over themselves in the direction to the front side featuring the hooking elements 12, i.e., toward the side facing the seating pipe 24. The fold lines 29 each extend in the longitudinal direction of the cover strip 10. In the illustrated embodiment, fold lines 29 are flush with the side walls 35 of the seating pipe 24. In the hook and loop connector piece pressed against the seating pipe 24, as is shown in FIG. 1, the cover strip 20 rests on the wall parts 22 which laterally delimit the mold trough or recess 28, with a double material layer. This double layer of the folded cover strip 20 acts like a sealing lip preventing penetration of foam material into the recess 28 in the foaming process, i.e., when the foaming mold is filled with foam material. This sealing is additionally promoted by the nonwoven-like configuration so that the hooking elements 12 of the support strip 10 held in the recess 28 are protected against the danger of being cemented by the penetrating foam material and consequently becoming unusable.

Along the wall parts 22 of the seating pipe 24, permanent magnet strips 30 or a row of individual permanent magnets, together with the ferromagnetic property of the cover strip 20, form a magnetic holding means or holder by which the folded side edge areas 21 of the cover strip 20 and thus of the hook and loop connector piece are secured on the seating pipe 24. In particular, the cover strip 20 preferably is formed from a nonwoven and acquires its ferromagnetic property by embedding ferromagnetic particles in the material of the cover strip 20. The use of a nonwoven cover strip 20 enables good sealing action relative to the polyurethane mold foam placed in the foam mold for producing cushion parts for vehicle seats, including aircraft passenger seats, so that it is ensured that the hook and loop connector pieces are reliably anchored by foaming in on the cushion part for their later use and connection to the covering material of a seat.

On the side of the hook and loop connector piece facing away from the hooking elements 12, a connecting means or connector 36 for the mold foam is provided. The strip-like connecting means or support strip 36 has a plurality of projecting individuals rods 38, one being shown enlarged in FIG. 3. These individual rods 38 permit adhesion of the mold foam to the actual hook and loop connector piece without projections, that is, without projecting anchor elements. The individual rods 38 can be produced analogously to the screen technology described in DE 198 28 856 C2 for producing hooking elements 12. However, the respective shaping cavity of the screen is not completely filled with the plastic material, so that before reaching the bottom of the mold the plastic material is already starting to harden. The individual rods 38 on their free ends then do not acquire the head configuration, as are characteristic for the hooking elements 12 as a mushroom closure part. In terms of their external shape, the individual rods 38 relative to their middle part are similar to the stalks of the hooking elements 12 connected to the head parts toward the free end. The individual rods 38 are an integral part of the strip-like connecting means 36 of plastic material. A suitable adhesive is used to produce the connection between the connecting means 36 and the back of the cover strip 20.

Figure 4:
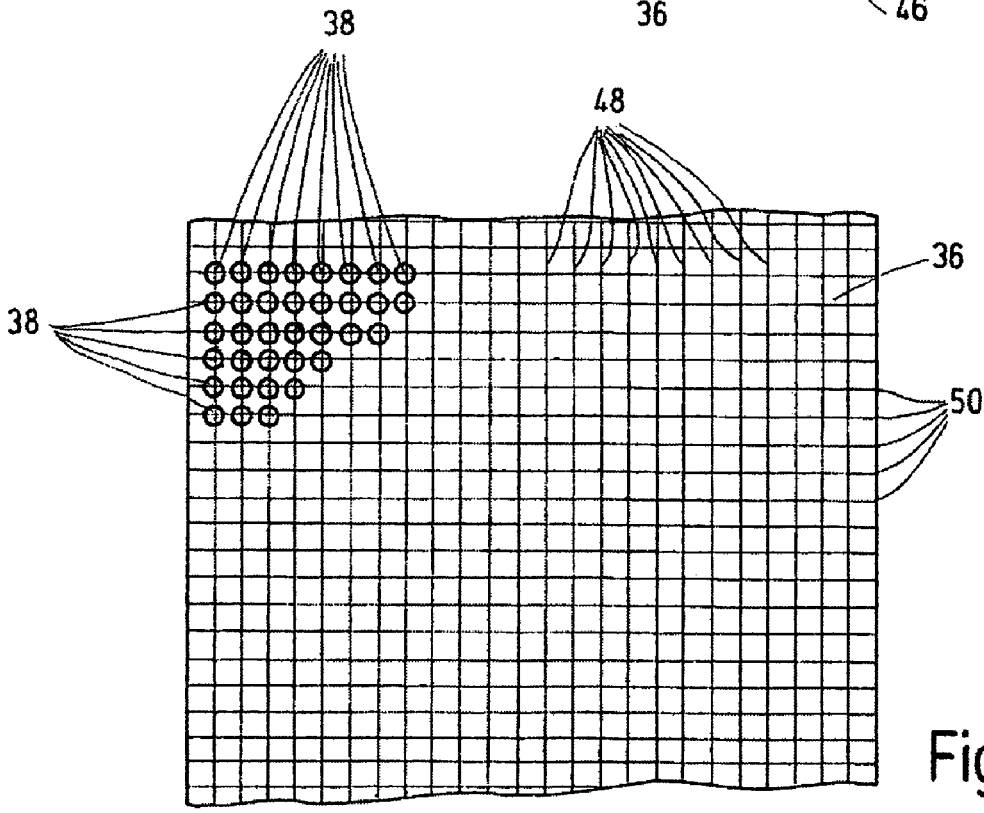
FIG. 4 is another top plan view of the hook and loop connector piece, viewed in the direction of its back facing away from the hooking elements.

The connecting means 36 in contrast to FIGS. 1 and 4 need not extend over the entire width of the cover strip 20. Optionally, only partial extension (not shown) is sufficient. To bring about a back-to-back configuration, the individual rods 38 could also be configured on the back of the support strip 20 with the hooking elements 12. The cover areas (respective free side edge area 21) would then have to be connected along the longitudinal edges 33 of the support strip 10 (not shown).

Figure 3:
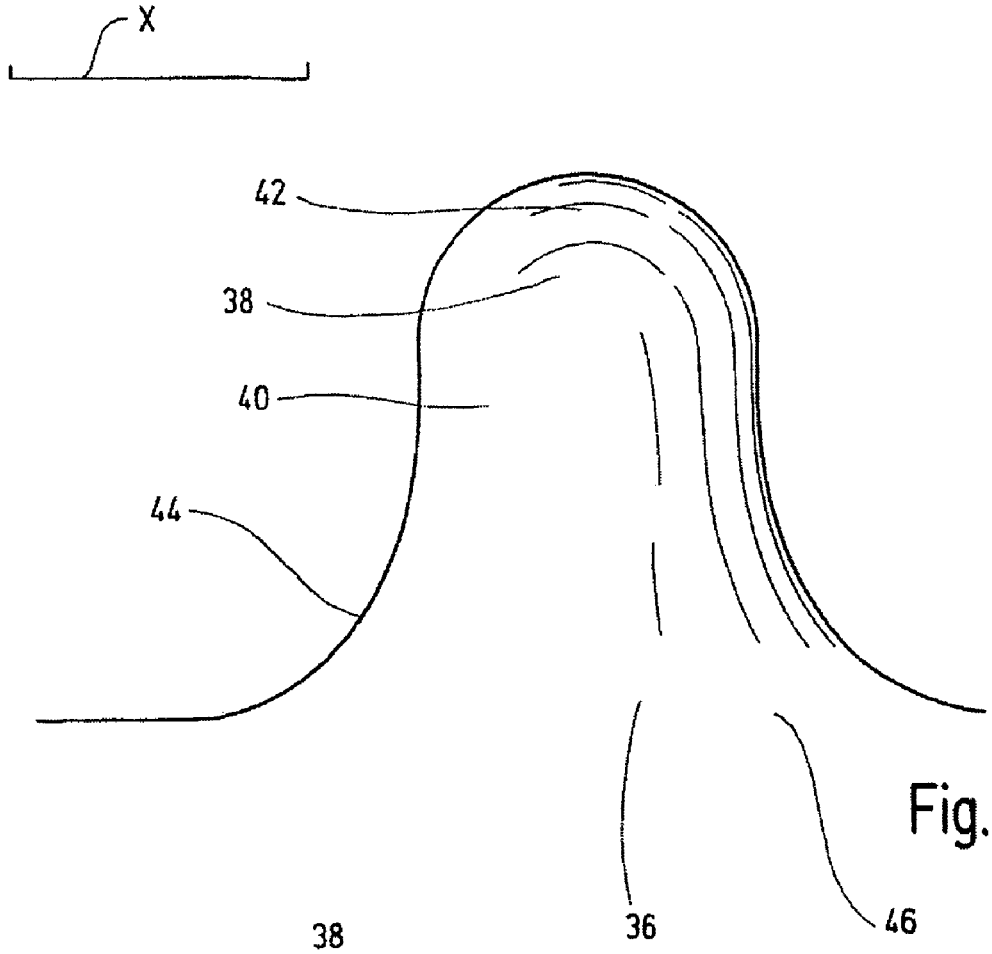
FIG. 3 is a side elevational view of a single individual rod as part of the connecting means of FIG. 1.

As shown especially in the enlarged view of FIG. 3, each individual rod 30 has a cylindrical middle part 40 which undergoes transition on the head side into a convexly shaped head part 42. On the foot side, each rod ends in a strip-shaped support part 46 as a component of the connecting means 36 by a concavely shaped foot part. As shown in FIG. 4, the individual rods 38 are located in longitudinal rows 48 and transverse rows 50. A checkerboard pattern is formed, and at each connecting point between the longitudinal rows 48 and the transverse rows 50, one individual rod 38 is located. FIG. 4 shows that the distances between the adjacent individual rods 38 from the longitudinal row 48 and the assignable transverse row 50 are essentially the same. The distances between adjacently opposite individual rods are 400 to 700 μm, preferably roughly 600 μm. The diameter of the middle part 40 is roughly 200 μm, the size ratios with scale X being illustrated which in FIG. 3 at top left shows a length ratio of roughly 200 μm. The height of each individual rod 38 is approximately 400 μm. The total height of the support part 46 with the individual rods 38 seated is approximately 600 μm.

To achieve better adhesion of the individual rods 38 to the molded foam, the individual rods 38 are provided at least partially with a coating improving the adhesion or adherence of the foam. This coating can have a gradient action such that the mold foam is pulled toward the individual rods 38 and immediately hardens there. Using suitable methods, the surface energy of the plastic material can be increased, by plasma processes, corona processes and gas fluorination processes.

While one embodiment has been chosen to illustrate the invention, it will be understood by those skilled in the art that various changes and modifications can be made therein without departing from the scope of the invention as defined in the appended claims.

What is claimed is:

1. A hook and loop connector piece, comprising:

a support strip with opposite first and second sides and first and second longitudinal edges;

hooking elements located on said first side of said support strip;

at least one cover strip on said second side of said support strip, said strip having at least one free side edge area extending beyond said first longitudinal edge of said support strip and being folded over itself along a fold line extending in a longitudinal direction and folded in a direction of said support strip, an end edge of said free side edge area facing said first longitudinal edge of said support strip; and a plurality of individual projecting rods for forming a connection with molded foam extending from said cover strip in a direction away from said hooking elements, said rods being free of additional projections, each of said rods having a cylindrical middle part transitioning on a head side into a convex head part and ending on a foot side via a concave foot part in a strip-shaped support part integrally connected thereto.

2. A hook and loop connector piece according to claim 1 wherein said rods are arranged in longitudinal rows and transverse rows with distances between adjacent rods of one longitudinal row and one transverse row being equal.

3. A hook and loop connector piece according to claim 1 wherein each of said rods has a height of approximately 200 to 600 μm, and a diameter of approximately 200 to 250 μm.

4. A hook and loop connector piece according to claim 3 wherein said height is approximately 400 μm.

5. A hook and loop connector piece according to claim 1 wherein said support part is one of said support strip, connected to said support strip, and connected to said cover strip.

6. A hook and loop connector piece according to claim 1 wherein said free side edge area is wider than said support strip and extends along a back thereof.

7. A hook and loop connector piece according to claim 6 wherein said cover strip is located between said rods and said support strip.

8. A hook and loop connector piece according to claim 1 wherein said free side edge area being folded over has a height greater than a height of said hooking elements.

9. A hook and loop connector piece according to claim 1 wherein the piece has ferromagnetic properties; and a metal wire is embedded as a stiffening profile into an adhesive layer connecting said support strip and said cover strip.

10. A hook and loop connector piece according to claim 1 wherein a coating improving adhesion to molded foam at least partially covers said rods.

11. A hook and loop connector piece according to claim 10 wherein said coating is applied by one of a plasma process, a corona process and a gas fluorination process.

* * * * *